US005918774A

United States Patent [19]

Lund et al.

[11] Patent Number: 5,918,774

[45] Date of Patent: Jul. 6, 1999

[54] COMBINED LOCK AND ANTI-CLOG FEATURE FOR SPRAY PACKAGE

[75] Inventors: Mark T. Lund, West Chester; Charles D. Cook, Fairfield, both of Ohio

[73] Assignee: The Procter & Gamble Company, Cincinnati, Ohio

[21] Appl. No.: 08/785,499

[22] Filed: Jan. 17, 1997

[51] Int. Cl.[6] ..... B05B 11/00; B65D 83/16

[52] U.S. Cl. ..... 222/153.13; 222/148; 222/380; 222/384

[58] Field of Search ..... 222/148, 153.13, 222/380, 384, 402.11

[56] References Cited

U.S. PATENT DOCUMENTS

| | | | |
|---|---|---|---|
| 2,598,308 | 5/1952 | Samuels et al. | 299/150 |
| 2,706,660 | 4/1955 | Johnson et al. | 299/95 |
| 2,781,950 | 2/1957 | Pritchard | 222/82 |
| 3,050,219 | 8/1962 | Sagarin et al. | 222/549 |
| 3,180,536 | 4/1965 | Meshberg | 222/394 |
| 3,249,260 | 5/1966 | Goldberg | 222/182 |
| 3,325,054 | 6/1967 | Braun | 222/39 |
| 3,422,996 | 1/1969 | Lipman | 222/384 |
| 3,426,948 | 2/1969 | Stirling | 222/402.11 |
| 3,460,719 | 8/1969 | O'Donnell et al. | 222/320 |
| 3,474,939 | 10/1969 | O'Donnell et al. | 222/320 |
| 3,484,023 | 12/1969 | Meshberg | 222/402.11 |
| 3,601,290 | 8/1971 | Nigro | 222/402.11 |
| 3,606,966 | 9/1971 | Rait | 222/402.11 |
| 3,721,423 | 3/1973 | Shay | 251/100 |
| 3,738,537 | 6/1973 | Gach | 222/153 |
| 3,770,167 | 11/1973 | Ewald | 222/153 |
| 3,770,170 | 11/1973 | Hayes | 222/402.11 |
| 3,779,427 | 12/1973 | Ewald | 222/153 |
| 3,782,605 | 1/1974 | Messenger | 222/153 |
| 3,827,606 | 8/1974 | Knickerbocker | 222/384 |
| 3,860,149 | 1/1975 | Hagianis | 222/153 |
| 3,894,665 | 7/1975 | Swenson | 222/402.11 |
| 3,937,368 | 2/1976 | Hoagland | 222/402.11 |
| 4,324,351 | 4/1982 | Meshberg | 222/402.11 |
| 4,354,621 | 10/1982 | Knickerbocker | 222/47 |
| 4,418,842 | 12/1983 | Di Loreto | 222/153 |
| 4,420,096 | 12/1983 | Kirk, Jr. | 222/44 |
| 4,566,611 | 1/1986 | Sukopp | 222/153 |
| 4,572,410 | 2/1986 | Brunet | 222/402.11 |
| 4,620,646 | 11/1986 | Crapser | 222/153 |
| 4,776,491 | 10/1988 | Nitta | 222/153 |
| 4,838,460 | 6/1989 | Knickerbocker | 222/153.13 |
| 4,848,595 | 7/1989 | Foster et al. | 222/153.13 |
| 4,972,974 | 11/1990 | Chavkin et al. | 222/153 |
| 5,016,783 | 5/1991 | Hayes et al. | 222/153.13 |
| 5,070,611 | 12/1991 | Derin et al. | 30/41 |
| 5,105,988 | 4/1992 | Knickerbocker | 222/148 |
| 5,158,211 | 10/1992 | Meshberg | 222/153.13 |
| 5,255,823 | 10/1993 | Tichy et al. | 222/153 |
| 5,379,924 | 1/1995 | Taylor | 222/402.11 |
| 5,388,730 | 2/1995 | Abbott et al. | 222/153 |

FOREIGN PATENT DOCUMENTS 0 657 223 A1 12/1994 European Pat. Off. .

*Primary Examiner*—J. Casimer Jacyna
*Attorney, Agent, or Firm*—William Scott Andes

[57] ABSTRACT

Disclosed is a spray package having a container body, an actuator, and a shroud between the container body and the actuator. The actuator has a nozzle, and is adjustable between a locked position and an unlocked position by rotation of the nozzle about the actuator's longitudinal axis. The unlocked position allows vertical movement of the actuator for dispensing product from the package, and the locked position prevents vertical movement of the actuator to prohibit dispensing of product from the package. The locked position simultaneously provides cooperation between the nozzle and an anti-clog member, connected to and extending above the shroud. The anti-clog member has a nozzle seal on its inside surface which inhibits clogging of product within and about the nozzle when the seal is in contact with the nozzle.

10 Claims, 3 Drawing Sheets

COMBINED LOCK AND ANTI-CLOG FEATURE FOR SPRAY PACKAGE

FIELD OF THE INVENTION

The present invention relates to locks and anti-clog features for spray packages. The present invention has further relation to such features which operate cooperatively with each other.

BACKGROUND OF THE INVENTION

Hair spray packages are typically either the manually actuated pump type or the aerosol type. Sprays formed from aerosols rely on a liquefied propellant to "flash off" for creating the spray, while manually actuated pump sprayers generate a hydraulic pressure which shears the liquid in the nozzle so as to create ligaments and droplets, i.e., the spray.

One of the major problems that consumers deal with when using manually actuated pumps is clogging. Clogs typically occur in the nozzle when product dries out behind and in front of the nozzle orifice insert, thereby causing a blockage which may be either full or partial. Full blockages completely interrupt flow, whereas partial blockages will typically block one or more swirl vanes resulting in a very irregular and coarse spray.

Many prior art spray packages utilize anti-clogging actuators on manually actuated sprayers. For example, U.S. Pat. No. 5,207,785 to Knickerbocker discloses a protector cap that covers the discharge orifice of the nozzle insert when the spray package is not in use. The cap uncovers the nozzle when pressure is applied to the actuator, and covers it again when the pressure is released. This results in reduced drying out and clogging of residual product in the nozzle. A drawback of the Knickerbocker invention is that it requires at least one extra part that must be manufactured and assembled onto the package, resulting in increased cost and complexity, and a higher probability of malfunction. The art is replete with additional devices which utilize mechanical means for anti-clogging; however, each design requires additional parts, cost, and complexity over conventional nozzles that do not incorporate anti-clogging means.

Another major unmet need among spray package users is the inconvenience of using a separate lid or overcap to prevent accidental actuation of the sprayer, for example during traveling or other transportation of the package. Many consumers throw this overcap away immediately after purchase, having no desire to continually take the cap off before each use and put it back on after each use. Other consumers do not mind the burden of continually removing and replacing the cap before and after each use. In any event, this overcap is an extra part that must be manufactured and assembled onto the package, and may be easily lost.

The present device solves the problems of the prior art by providing an anti-clog feature which cooperates with a locking feature. The anti-clog feature is built into the package shroud, thereby eliminating extra components, and the lock feature automatically engages when the actuator of the present device is put in the anti-clog position.

SUMMARY OF THE INVENTION

Disclosed is a spray package having a container body, an actuator, and a shroud between the container body and the actuator. The actuator has a nozzle and is adjustable between a locked position and an unlocked position. The unlocked position allows vertical movement of the actuator for dispensing product from the package, and the locked position prevents vertical movement of the actuator to prohibit dispensing of product from the package. The locked position simultaneously provides cooperation between the nozzle and an anti-clog member, connected to and extending above the shroud. The anti-clog member has a nozzle seal on an inside surface proximate to the actuator. The seal inhibits clogging of product within and about the nozzle when the seal is in contact with the nozzle.

The actuator may be rotationally adjustable with respect to the neck area, or the neck area may be rotationally adjustable with respect to the actuator. The actuator may have an angled depression on the top surface to accommodate a human index finger.

The anti-clog member may be an extension extending above the shroud and having a nozzle seal on its inside surface. The nozzle seal sealingly seats within the nozzle when the actuator is in the locked position. The actuator may have an outer surface which is provided with ribbing to improve gripability, and may have a click member extending from the actuator to provide an audible click indicating that the actuator is in the locked position. There may be at least one actuator stop which prevents the actuator from being rotated past the locked position and the unlocked position. Finally, there may be indicia on the package which indicate that the package is in the locked position and the unlocked position respectively.

BRIEF DESCRIPTION OF THE DRAWINGS

While the specification concludes with claims particularly pointing out and distinctly claiming the subject invention, it is believed the same will be better understood from the following description taken in conjunction with the accompanying drawings in which:

DETAILED DESCRIPTION OF THE INVENTION

Figure 1:
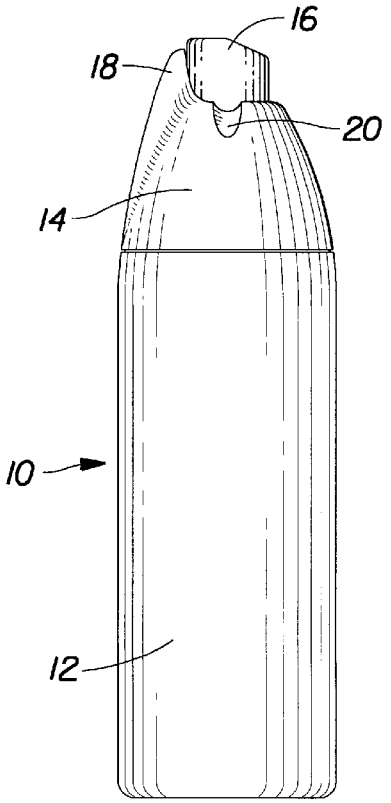
FIG. 1 is an elevational view of a spray package of the present invention.

Referring now to the drawings in detail wherein like numerals indicate the same element throughout the views there is shown in FIG. 1 an elevational view of a spray package 10 of the present invention. Specifically shown are container body 12, shroud 14, and actuator 16. Container body 12 is typically a one-piece plastic blow-molded bottle, but may be made of metal, or any other material known to the art, and may be made in multiple parts if need be. Actuator 16 and shroud 14 are typically plastic injection-molded parts, but also may be made of other materials, and in multiple parts. Shroud 14 masks an underlying threaded closure, provides for anti-clog wiper 18, and also provides a new and different look for a spray container.

Figure 3:
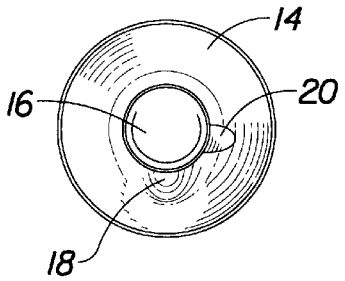
FIG. 3 is a plan view of the package of FIG. 1.
Figure 2:
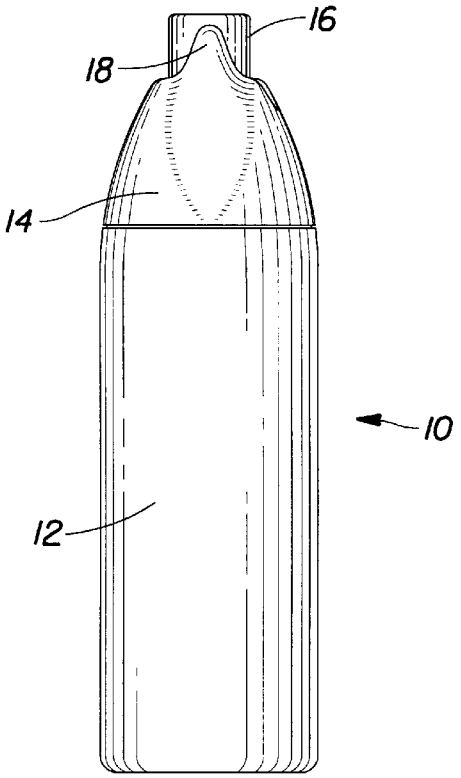
FIG. 2 is the elevational view of FIG. 1, turned 90 degrees about its longitudinal axis.

In this view, the spray nozzle of actuator 16 is facing into the anti-clog wiper 18 which extends upwardly from the top of shroud 14. This corresponds both to the position in which the actuator is locked and dispensing cannot take place, and the position in which the nozzle is sealed by anti-clog wiper 18 so that product will not dry out and clog within the nozzle. Notch 20 indicates the unlock position which actuator 16 may be turned to for dispensing product; this position is approximately 80 to 90 degrees from the position of anti-clog wiper 18 so that wiper 18 will not interfere with the user's finger during actuation. FIG. 2 shows a head-on view of wiper 18, and FIG. 3 is a plan view showing the positions of wiper 18 and notch 20 approximately 80 to 90 degrees from each other.

Figure 4A:
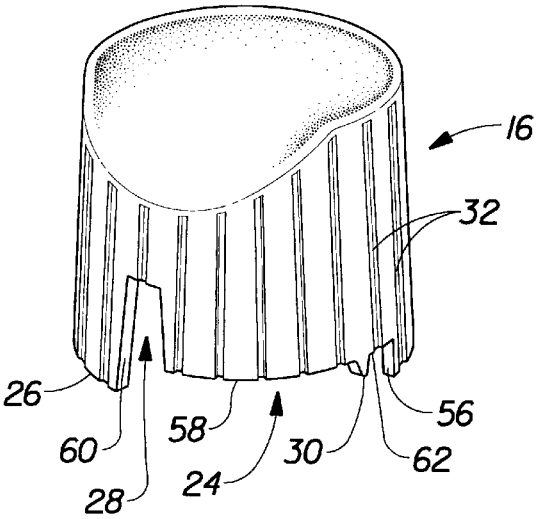
FIG. 4*a* is a perspective elevational view of an actuator of the present invention, showing a portion of the locking mechanism.
Figure 4B:
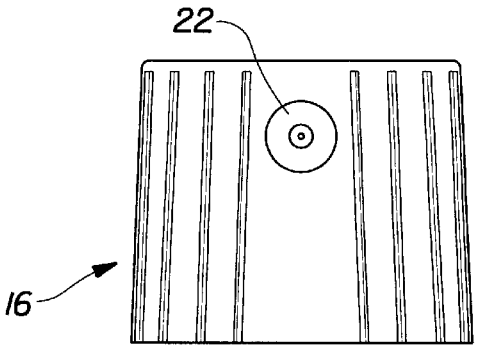
FIG. 4*b* is an elevational view of the actuator of FIG. 4*a* showing the nozzle.

FIGS. 4*a* and 4*b* are exploded views of actuator 16, showing nozzle 22 which is inserted into a sleeve within actuator 16 and which swirls the fluid product to create a spray of a predetermined quality. Also included on actuator 16 is a cutout area 24, which extends approximately 80 to 90 degrees around the actuator skirt 26 to allow rotational movement of actuator 16 between the locked and unlocked positions. Actuator slot 28 provides for the unlocked position, and has a height equal to the stroke length of the pump. The side walls of slot 28 may be slightly tapered to allow a stop (38 in FIG. 6) to easily ride within slot 28. Tab 30 provides for a "click" sound when actuator 16 is put into the locked position, to notify the user. The function of cutout area 24 will be described in more detail below. Ribbing 32 may be added to the sidewalls of actuator 16 for better gripping during rotation between the locked and unlocked positions.

Figure 5:
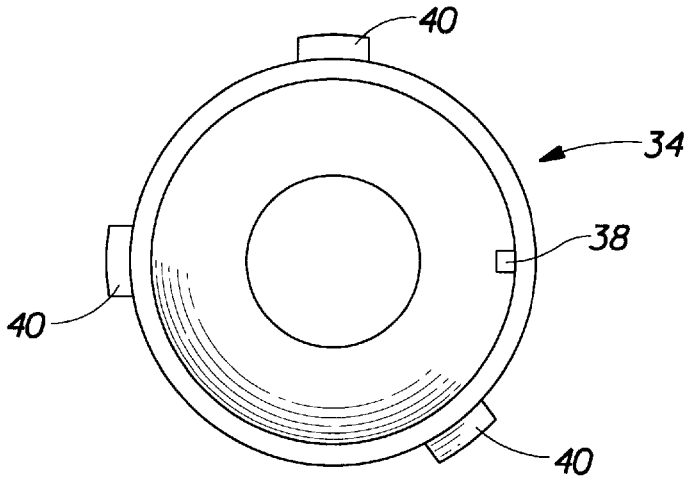
FIG. 5 is a plan view of a spray package closure of the present invention.
Figure 6:
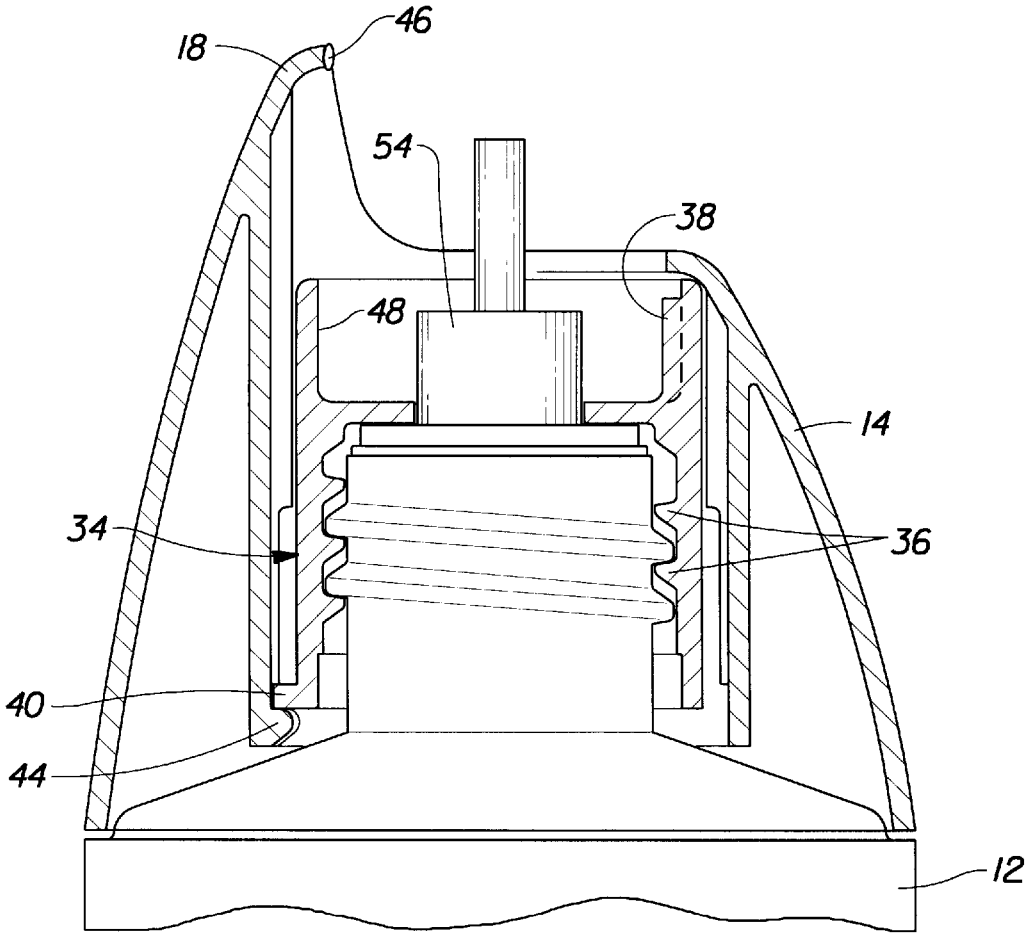
FIG. 6 is an elevational view of the closure of FIG. 5, along with an elevational cross-section of the shroud.

FIGS. 5 and 6 show plan and elevational views of closure 34 respectively. Closure 34 is hidden by shroud 14 when package 10 is assembled. Closure 34 contains threads 36 which enable closure 34 to be torqued onto container body 12. Threads 36 may be provided with some type of stop (not shown) that engages with a stop on the threads of body 12 to enable closure 34 to be stopped at a certain rotational position, in which wiper 18 will align with a label on body 12 in a predetermined position. Included on the inner hub of closure 34 is actuator stop 38 which cooperates with cutout area 24 on actuator 16 to provide for the lock/unlock mechanism. The width of stop 38 corresponds to the width of slot 28 so that stop 38 may easily ride up and down within slot 28 when actuator 16 is in the unlocked position. The position of the top of stop 38 corresponds with the height of slot 28 and the stroke length of the pump. A series of lugs 40 are provided on the outside of closure 34 which cooperate with latches 44 of shroud 14 to secure shroud 14 to closure 34. Lugs 40 may be positioned such that shroud 14 may be secured to closure 34 in only one predetermined position, when a specific orientation between closure 34 and shroud 14 is desired. Note that in FIG. 5, two of the lugs 40 are 90 degrees from each other, whereas the third lug 40 is approximately 135 degrees from each of the other two. If the latches 44 are positioned to match the lug pattern, shroud 14 may only be attached to closure 34 in one specific orientation.

FIG. 6 also shows a sectional view through shroud 14. Again, specific predetermined positioning of latches 44 and lugs 40 allows shroud 14 to be attached to closure 34 in a specific predetermined orientation. Wiper 18 has bead 46 on its tip, for engagement with nozzle 22 when actuator 16 is in the locked position. Actuator 16 slides up and down within sleeve 48 during actuation.

Figure 7:
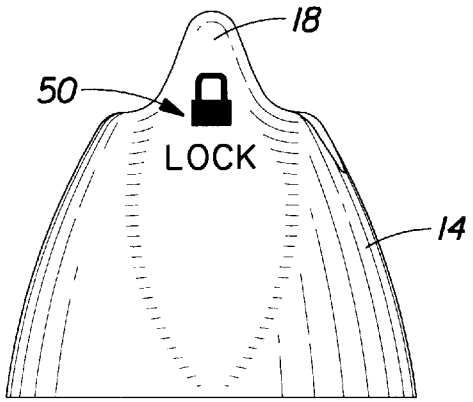
FIG. 7 is an elevational view of the shroud corresponding to the view shown in FIG. 2.
Figure 8:
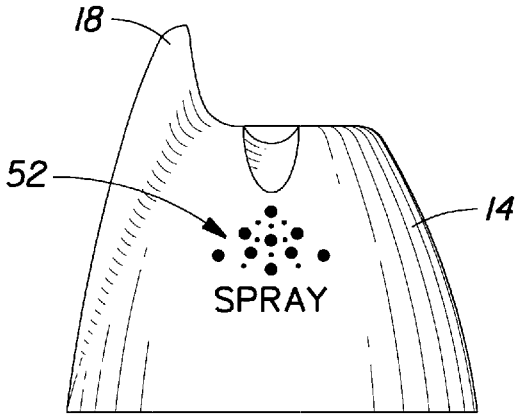
FIG. 8 is an elevational view of the shroud corresponding to the view shown in FIG. 1.

FIGS. 7 and 8 show shroud 14 with indicia 50 and 52, which may be provided to show the locked and unlocked positions for actuator 16 respectively. When actuator 16 is turned so nozzle 22 faces wiper 18, the package is locked. When actuator 16 is turned so nozzle 22 is exposed above notch 20, the package is unlocked.

During assembly, nozzle 22 is placed inside of actuator 16 using conventional means. Similarly, pump cartridge 54 (FIG. 6) is placed into closure 34 using conventional means. Actuator 16 is then placed onto pump cartridge 54 so that it is oriented corresponding to the locked position. This position puts actuator stop 38 between tab 30 and surface 56 (FIG. 4*a*) when actuator 16 is fully assembled onto pump cartridge 54. Next, shroud 14 is assembled onto closure 34 such that lugs 40 are aligned with latches 44; this puts bead 46 into contact with nozzle 22 when shroud 14 is fully in place on package 10. This completed unit is then attached to container body 12, after body 12 has been filled with product. As stated earlier, thread stops may be employed to orient wiper 18 with respect to a package label in a specific predetermined orientation.

To dispense product, actuator 16 is gripped using the thumb and index finger, and is rotated counterclockwise so as to expose nozzle 22 and put it in a location directly above notch 20. At this time the top of actuator stop 38 rides past tab 30 and along surface 58, until stop 38 hits surface 60. At this point stop 38 is free to ride up and down within slot 28 when actuator 16 is depressed, and actuation may take place. When actuator 16 is not depressed, the top of stop 38 is at a position slightly below surface 58.

When finished, actuator 16 may be rotated clockwise; when the top of stop 38 passes tab 30, an audible "click" occurs which notifies the user that package 10 is locked and nozzle 22 is sealed. In this position, the top of stop 38 hits surface 62 if a user attempts to depress actuator 16, and spraying cannot take place.

Alternative embodiments of this device include those in which actuator 16 is provided with a male component instead of the female components shown in FIG. 4; in this case, closure 34 would be provided with the female components corresponding to that shown on actuator 16 in FIG. 4 instead of stop 38. Also, instead of providing the device so that actuator 16 is turned to accomplish locking and unlocking, the device may be provided so that shroud 14 is turned to accomplish locking and unlocking. Additionally, the seal between bead 46 and nozzle 22 may be achieved if both nozzle 22 and bead 46 are flat, if nozzle 22 is convex and bead 46 is concave, if nozzle 22 is concave and bead 46 is convex, or just about any combination of these various shapes.

U.S. Pat. No. 5,560,544, incorporated by reference herein, discloses a spray nozzle made with reduced wettability materials. These materials ensure that product will tend to bead up on the nozzle surfaces, rather than to coat the surfaces, thereby reducing the incidence of clogging. Such materials may be used with the present invention to improve overall anti-clogging of the nozzle.

While particular embodiments of the present invention have been illustrated and described herein it will be obvious to those skilled in the art that various changes and modifications can be made without departing from the spirit and scope of the present invention and it is intended to cover in the appended claims all such modifications that are within the scope of this invention.

What is claimed is:

1. A spray package having a longitudinal axis, the package comprising a container body and an actuator, the container body having a neck area proximate to the actuator, the actuator having a nozzle and being adjustable between a locked position and an unlocked position, the unlocked position allowing vertical movement of the actuator for dispensing product from the package, and the locked position preventing vertical movement of the actuator to prohibit dispensing of product from the package, the locked position simultaneously providing cooperation between the nozzle and an anti-clog member, connected to the neck area, which inhibits clogging of product within and about the nozzle, said neck area comprises a shroud which is located between the container body and the actuator, said anti-clog member comprising an extension extending above the shroud and having a bead forming a nozzle seal on a surface proximate to the actuator, such that said nozzle seal sealingly sits within the nozzle when the actuator is in the locked position.

2. The spray package according to claim 1, wherein the actuator is rotationally adjustable about the longitudinal axis with respect to the neck area.

3. The spray package according to claim 1, wherein the neck area is rotationally adjustable about the longitudinal axis with respect to the actuator.

4. The spray package according to claim 1, wherein the spray package further comprises a pump sprayer.

5. The spray package according to claim 1, wherein the actuator has a top surface, the actuator further comprising an angled depression on the top surface to accommodate a human index finger.

6. The spray package according to claim 1, wherein the actuator has an outer surface which is provided with ribbing to improve gripability.

7. The spray package according to claim 4, further comprising a click member extending from the actuator to provide an audible click indicating that the actuator is in the locked position.

8. The spray package according to claim 7, further comprising at least one actuator stop which prevents the actuator from being rotated past the locked position and the unlocked position.

9. The spray package according to claim 8, further comprising indicia which indicate that the package is in the locked position and the unlocked position respectively.

10. The spray package according to claim 1, wherein said nozzle and said bead have complementary shapes.

* * * * *

UNITED STATES PATENT AND TRADEMARK OFFICE

CERTIFICATE OF CORRECTION

PATENT NO. : 5,918,774

DATED : July 6, 1999

INVENTOR(S) : Mark T. Lund et al.

It is certified that error appears in the above-identified patent and that said Letters Patent is hereby corrected as shown below:

Column 6, line 1 of Claim 7, "4," should read "6,".

Signed and Sealed this

Tenth Day of April, 2001

Nicholas P. Godici

*Attest:*

NICHOLAS P. GODICI

*Attesting Officer*

*Acting Director of the United States Patent and Trademark Office*